US006840176B1

(12) United States Patent
Armoni

(10) Patent No.: US 6,840,176 B1
(45) Date of Patent: Jan. 11, 2005

(54) CTP SYSTEMS HAVING AT LEAST ONE MULTI-CASSETTE UNIT AND METHODS FOR LOADING PLATES

(75) Inventor: Nir Armoni, Ganei Tikva (IL)

(73) Assignee: Creo IL. Ltd., Herzlia B (IL)

( * ) Notice: Subject to any disclaimer, the term of this patent is extended or adjusted under 35 U.S.C. 154(b) by 0 days.

(21) Appl. No.: 10/725,976

(22) Filed: Dec. 2, 2003

(51) Int. Cl.[7] ..... B41L 47/14
(52) U.S. Cl. ..... 101/477; 414/788.8
(58) Field of Search ..... 101/477, 483, 101/485, 486; 347/262, 264; 414/788.8, 796.2, 796.9, 797; 271/9.06, 145, 162

(56) References Cited

U.S. PATENT DOCUMENTS 5,738,014 A * 4/1998 Rombult et al. ..... 101/477
5,992,324 A * 11/1999 Rombult et al. ..... 101/477
6,341,932 B1 * 1/2002 Otsuji ..... 414/403
2004/0151571 A1 * 8/2004 Zahavi et al. ..... 414/788.8

* cited by examiner

*Primary Examiner*—Leslie J. Evanisko
(74) *Attorney, Agent, or Firm*—Wilmer Cutler Pickering; Hale and Dorr LLP

(57) ABSTRACT

Two dual-configuration systems for loading plate in a CTP imager; in the first configuration one multi-cassette unit (MCU) serves two CTP imagers and in the second configuration two MCUs serve one CTP imager.

32 Claims, 4 Drawing Sheets

CTP SYSTEMS HAVING AT LEAST ONE MULTI-CASSETTE UNIT AND METHODS FOR LOADING PLATES

FIELD OF THE INVENTION

The present invention relates to the loading and exposure of printing plates and more specifically to on-line plate availability for enhanced productivity.

BACKGROUND OF THE INVENTION

A CTP system accepts input jobs/pages written in a page description language, for example, Postscript. The jobs are sent through a raster image processor to a platemaker for exposure. The platemaker engine images the raster data on a plate, which is later mounted on the press, inked and made ready for printing.

The inclusion of a CTP system in a printing operation suggests a greater extent of automation that can be achieved. A full CTP process can automate, through the use of computers and special equipment, the transfer of information from the original layout to the press plate.

Also included in the automation of a CTP system is the media handling. It is necessary to supply plates individually from a plate supply area to the platemaker engine and it is desirable to reduce the amount of operator handling involved. Unexposed plates are normally supplied in packages of 25 to 100 plates, with interleaf paper-sheets between the plates for protecting the emulsion side of the plates, which is extremely sensitive to scratches. The stack of plates needs to be loaded into a supply area of a platemaker in a manner that will keep the stack of plates aligned with automation mechanisms for removing a plate from the stack, and for discarding the interleaf sheets from the stack.

U.S. Pat. No. 5,992,324 to Rombult et at describes an automatic plate loading system, including a plate handler, in which plates are stored horizontally in equal-sized stacks and a slip-sheet removal mechanism. When the stack containing plates of the required size has been positioned in an access position inside the plate handler, a feeding mechanism picks the topmost plate and transports it to the imaging area. Air flow is then activated to peel off an edge of the slip-sheet, followed by gripping the peeled-off edge by mechanical "fingers" and lowering the cassette to further separate the slip-sheet from the plate above. The slip-sheet is then sucked by suction-cups, to separate it from the plate underneath and is rotatably driven out of the cassette and released.

The Lotem CTP machine, produced and sold by Creo Inc., Canada, also includes a horizontal plate-storage in cassettes, wherein the cassettes move vertically and the active cassette slides out of the storage area and into a plate-picking position within the imaging unit, where a picker picks the topmost plate and subsequently the slip-sheet lying underneath the picked plate.

These loading systems, though efficient, require extensive use of floor space for accommodating the plate storage area, the imaging system and the transport space for moving the picked plate from the storage area to the imaging unit. The design of these systems requires additional floor space for supplying new plates to the plate storage area, on one of the sides of the plate storage area different from the picking side, to enable smooth operation of the loading/imaging system while refilling plates into empty cassettes.

U.S. Pat. No. 6,341,932 to Otsuji discloses a plate loading mechanism comprising a plurality of cassettes stacked vertically; a slide mechanism for horizontally moving one of the cassettes; a lift mechanism for supporting and vertically moving the one of the cassettes horizontally moved by the slide mechanism, to a plate feed position for feeding plates to the image recording apparatus; and a transport mechanism for transporting the plates to the image recording apparatus from the one of the cassettes moved to the plate feeding position by the lift mechanism. This plate feeding apparatus is constructed to horizontally slide and then vertically move a cassette to place the cassette in the plate feed position for feeding plates to the image recording apparatus. The apparatus overcomes the first problem of the devices described above, namely the need to move vertically a number of plate-filled cassettes, yet, although proclaiming to be compact, fails to overcome the second problem of excessive floor space.

U.S. patent application Ser. No. 10/354,567 provides an improved plate loader that additionally reduces the required floor-space.

FIG. 1 is a schematic drawing of the CTP device of the prior-art. A cassette 15 is loaded, either manually or automatically, in the direction of arrow 18, onto table 14. A plate, picked from cassette 15, is transported by any means known in the art, such as vacuum, towards external drum 10, either directly or via intermediate station 12. Intermediate station 12 may serve for aligning and/or punching the plate prior to loading it onto the external drum 10 for imaging. After imaging, the plate is unloaded in the direction of arrow 20, preferably towards an in-line processor (not shown). The slip-sheets separating the plates are removed by any slip-sheet removal mechanism known in the art (not shown), and discarded into bin 16.

FIG. 2 shows the same schematic CTP layout as in FIG. 1, with an additional Multi-Cassette Unit (MCU) 22. Cassette 15 is transported from MCU 22 to table 14. MCU 22 comprises a number of cassettes 24, stored horizontally one on top of the other, each cassette preferably holding plates of a single size (26, 28). Each cassette preferably holds a plate-size different from the other cassettes. When new plates have to be filled in a cassette, the empty cassette is drawn out of the MCU 22 in the direction of arrow 30, plates filled manually, and cassette pushed back into its vertical position in the MCU.

All these prior-art plate-loading systems comprise configurations of a single plate loader serving a single CTP imager.

Luscher. AG of Switzerland provides the Xpose! automatic CTP system, using one plate loader to serve two internal drum plotters. A plate loader is positioned between the two plotters. A plate gets wrapped around a drum, which then moves towards one of the plotters and inserts the plate therein. The drum is then free to repeat the loading operation for the second plotter.

When long shifts of unattended plate-imaging are required, or, alternatively, a large number of different plate sizes is required for a certain run, the operation is limited by the number of cassettes in the MCU, usually not more than five. It would be advantageous to have a larger available number of on-line cassettes to attend to these needs.

SUMMARY OF THE INVENTION

In one aspect of the present invention there is provided a CTP system using one multi-cassette unit (MCU) for feeding two imaging units, comprising: two imaging units; an MCU comprising vertically stacked horizontal cassettes, each cassette holding a plurality of plates, each said cassettes slidably movable in two opposite directions to two plate-loading positions, each said cassettes additionally slidably movable in a third direction, perpendicular to said first and second directions; and two plate-loading positions, each positioned in one of said opposite directions, for receiving cassettes, each said plate-loading positions adapted to supply plates for a respective one of said imaging units.

According to one embodiment of this aspect, each of the plate-loading positions is adjacent a respective plate-registration station; and each of the plate-registration stations is adjacent an imaging unit.

According to a second embodiment of this aspect, the two plate-registration stations additionally comprise respective punching mechanisms.

According to a third embodiment of this aspect, the third direction enables filling plates into the cassettes.

According to a fourth embodiment of this aspect, the plurality of plates in each said cassettes is of a single size.

According to a fifth embodiment of this aspect, the CTP imager comprises an external drum.

In another aspect of the present invention there is provided a CTP system using two MCUs for feeding one imaging unit, comprising: an imaging unit; two MCUs, each comprising vertically stacked horizontal cassettes, each cassette holding a plurality of plates, each said cassettes slidably movable in two opposite directions to two plate-loading positions, each said cassettes additionally slidably movable in a third direction, perpendicular to said first and second directions; and a plate-loading position, positioned between said two plate-loaders, for receiving cassettes.

According to a first embodiment of this aspect, the plate-loading position is adjacent a plate-registration station; and the plate-registration station is adjacent said imaging unit.

According to a second embodiment of this aspect, the plate-registration station additionally comprise a punching mechanism.

According to a third embodiment of this aspect, the third direction enables filling plates into said cassettes.

According to a fourth embodiment of this aspect, the plurality of plates in each said cassettes is of a single size.

According to a fifth embodiment of this aspect, the CTP imager comprises an external drum.

In yet another aspect of the present invention there is provided a method of providing enhanced productivity in a CTP system, comprising the steps of: providing two CTP systems, each said systems comprising a plate-loading position and an imaging unit; providing an MCU comprising vertically stacked horizontal cassettes, each cassette holding a plurality of plates, each said cassettes slidably movable in two opposite directions to two plate-loading positions, each said cassettes additionally slidably movable in a third direction, perpendicular to said first and second directions; transferring a first cassette to the plate-loading position of a first one of said CTP systems; picking a plate from said transferred first cassette and transferring said picked plate to the imaging unit of said first one of said CTP systems; and transferring a second cassette to the plate-loading position, of a second one of said CTP systems, wherein said transferring a second cassette may be done any time following said step of transferring a first cassette.

According to a first embodiment of this aspect, the step of transferring said picked plate comprises the steps of: transferring said picked plate to a registration station for accurately registering said plate with respect to said CTP imager; and transferring said registered plate from said registration station to said CTP imager.

According to a second embodiment of this aspect, the plate-registration station additionally comprise a punching mechanism and the plate is punched after registration.

According to a third embodiment of this aspect, the third direction enables filling plates into said cassettes.

According to a fourth embodiment of this aspect, the plurality of plates in each said cassettes is of a single size.

According to a fifth embodiment of this aspect, the CTP imager comprises an external drum.

In another aspect of the present invention there is provided a method of providing a large amount of different-sized plates in a CTP device, comprising the steps of: providing a CTP system, said system comprising a plate-loading position, and a CTP imager; providing two MCUs, each comprising vertically stacked horizontal cassettes, each cassette holding a plurality of plates, each said cassettes slidably movable in two opposite directions, each said cassettes additionally slidably movable in a third direction, perpendicular to said first and second directions; searching said two MCUs for the MCU holding a cassette with a required plate size; transferring said cassette from said MCU to said plate-loading position; and picking a plate from said transferred cassette and transferring said picked plate to said CTP imager.

According to a first embodiment of this aspect, the step of transferring said picked plate to said CTP imager comprises the steps of: transferring said picked plate to a registration station, for accurately registering said plate with respect to said CTP imager; and transferring said registered plate from said registration station to said CTP imager.

According to a second embodiment of this aspect, the plate-registration station additionally comprises a punching mechanism and the plate is punched after registration.

According to a third embodiment of this aspect, the third direction enables filling plates into said cassettes.

According to a fourth embodiment of this aspect, the plurality of plates in each said cassettes is of a single size.

According to a fifth embodiment of this aspect, the CTP imager comprises an external drum.

BRIEF DESCRIPTION OF THE DRAWINGS

For a better understanding of the invention and to show how the same may be carried into effect, reference will now be made, purely by way of example, to the accompanying drawings. In the accompanying drawings.

DETAILED DESCRIPTION OF PREFERRED EMBODIMENTS

Figure 1:
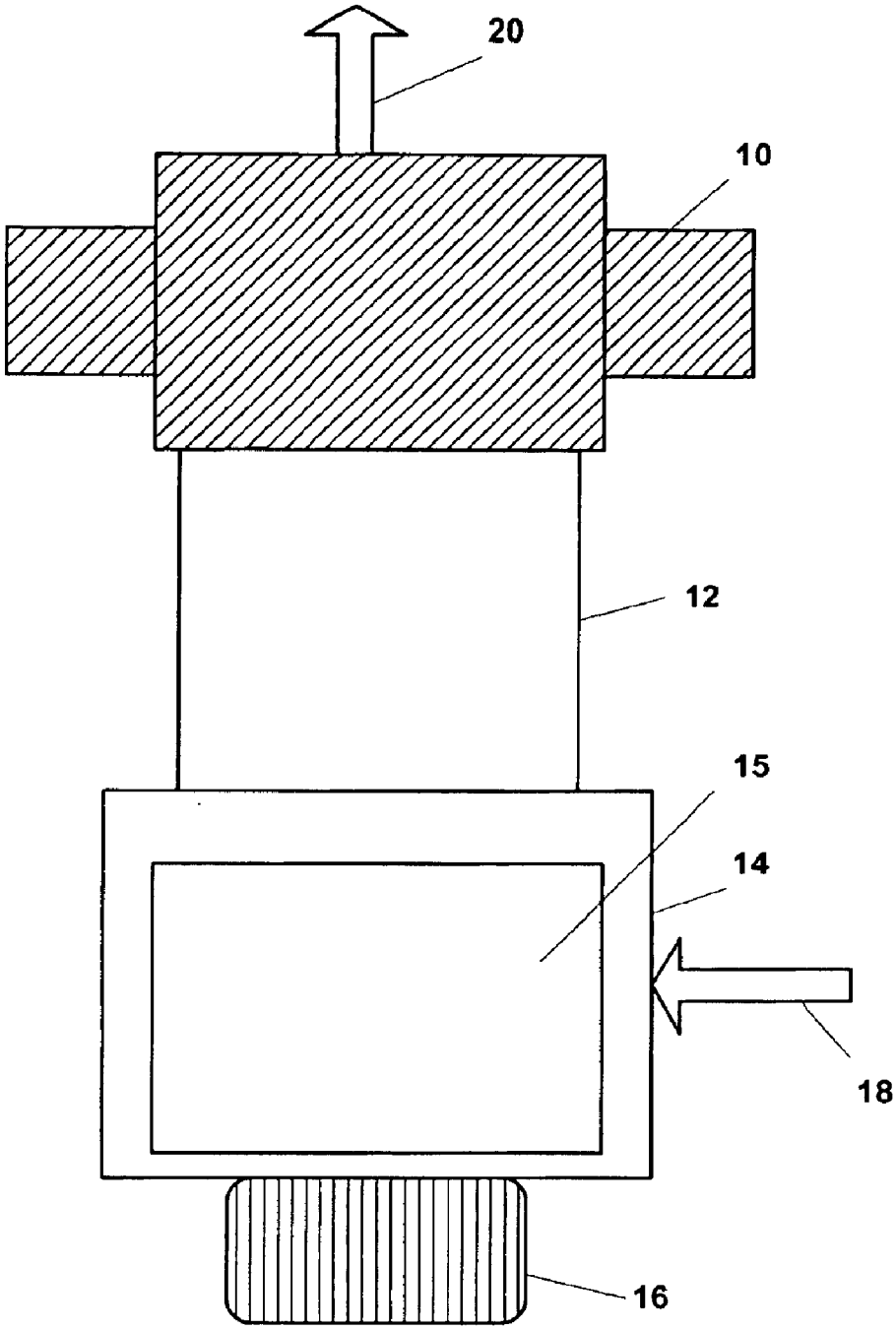
FIG. 1 (PRIOR ART)
FIG. 1 is a schematic illustration of a prior-art plate loading mechanism.

Before explaining at least one embodiment of the invention in detail, it is to be understood that the invention is not limited in its application to the details of construction and the arrangement of the components set forth in the following description or illustrated in the drawings. The invention is applicable to other embodiments or of being practiced or carried out in various ways. Also, it is to be understood that the phraseology and terminology employed herein is for the purpose of description and should not be regarded as limiting.

Figure 2:
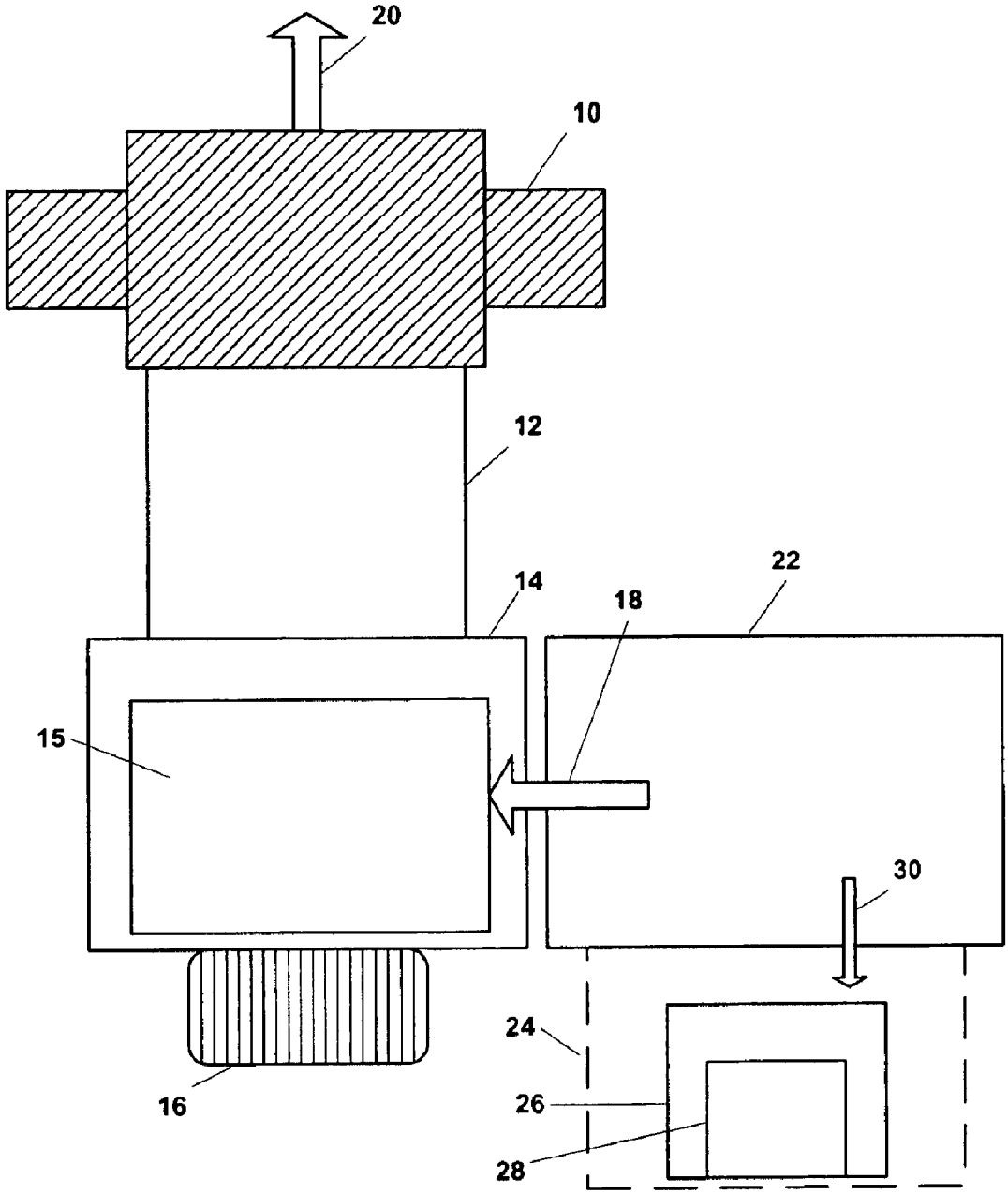
FIG. 2 (PRIOR ART)
FIG. 2 is a schematic illustration of a prior-art plate loading mechanism including an automatic plate loader with a multi cassette unit.
Figure 3:
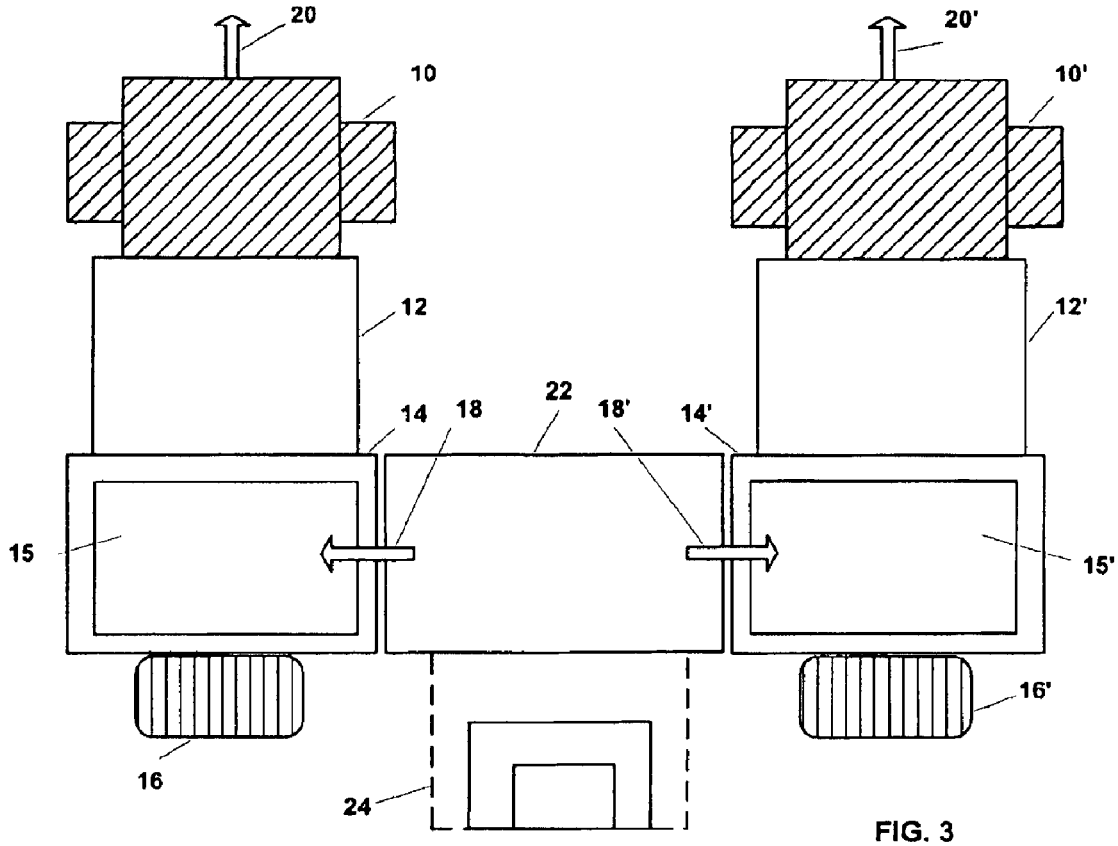
FIG. 3 is a schematic illustration of a configuration with one multi-cassette unit serving two CTP devices, according to a preferred embodiment of the present invention.

In the operation of a plate-loader, as described above in conjunction with FIG. 2, a cassette 15 of the required size is transported from the Multi-Cassette Unit (MCU) 22 onto table 14. In a normal sequence of events, this will be followed by a number (or all) of plates from cassette 15 being imaged sequentially on external drum plotter 10. During that time, MCU 22 of the configuration of FIG. 2 is practically idle, except for plate-filling operations that may be done, as described above. In the embodiment of FIG. 3, a second CTP device has been connected to MCU 22. The same 'tagged' numerals pertaining to the second CTP device have been assigned to similar components. The MCU 22 of the present configuration has the ability to transfer a chosen cassette to either side; left, for serving imager 10 and right, for serving imager 10'. Thus, having transferred cassette 15 to table 14, the MCU may now transfer cassette 15' to table 14' of the second CTP device. Similar to the above description, plates are transferred for imaging from cassette 15' to external drum 10' via station 12', where registration and punching may be done. At the end of a plate imaging session, the plate is transported in the direction of arrow 20', preferably to an in-line processor. Slip-sheets are disposed into bin 16'.

The configuration of FIG. 3 doubles the throughput of a CTP device with MCU and automatic plate-loading, while saving the cost and floor-space of a second plate loader.

Figure 4:
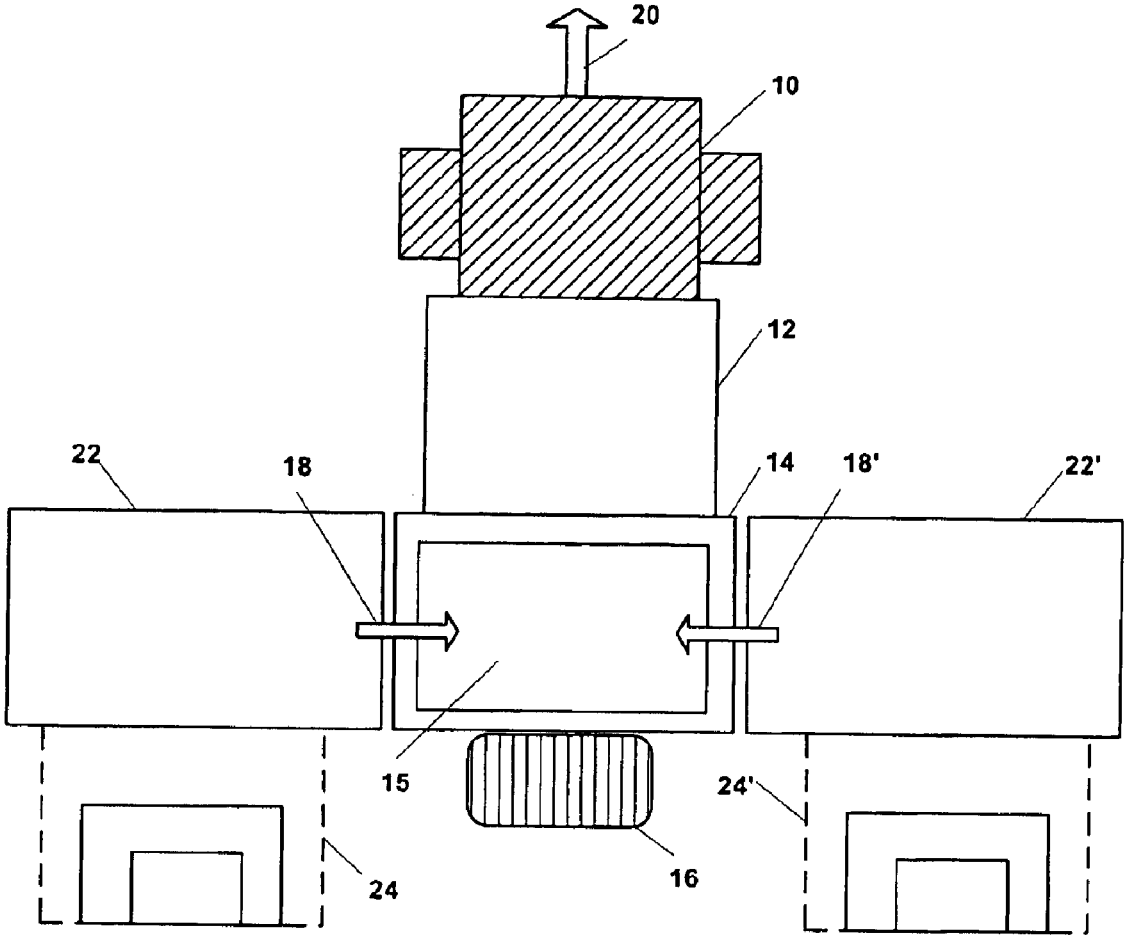
FIG. 4 is a schematic illustration of a configuration with two multi-cassette units serving one CTP device, according to a preferred embodiment of the present invention.

FIG. 4 is a schematic illustration of yet another configuration, in which two MCUs serve one CTP device. This configuration may be preferred when a great variety of plate sizes is required to be on-line, for example during an unattended night shift, when re-filling plates is impossible. The two MCUs may double the number of different plate-sizes available to the CTP device. In the operation of the configuration of FIG. 4, a cassette holding a certain plate-size is required for a job. If a cassette of the required size is located in MCU 22, it will be transferred to table 14 in the direction of arrow 18. On the other hand, if the required cassettes 24 resides in MCU 22', it will be transferred to table 14 in the direction of arrow 18'.

It will be appreciated by persons skilled in the art that the present invention is not limited to what has been particularly shown and described hereinabove. Rather the scope of the present invention is defined by the appended claims and includes both combinations and sub-combinations of the various features described hereinabove as well as variations and modifications thereof which would occur to persons skilled in the art upon reading the foregoing description. For example, the CTP imager is not limited to the exemplary external drum imager and could also be internal drum or flatbed and the MCU is not limited to an MCU having vertically stacked horizontal cassettes.

What is claimed is:

1. A CTP system using one multi-cassette unit (MCU) for feeding two imaging units, comprising:

two imaging units;

two plate-loading positions, each of said plate-loading positions adapted to supply plates for a respective one of said imaging units; and an MCU comprising a plurality of cassettes, each cassette holding a plurality of plates, each said cassettes movable to any one of said two plate-loading positions.

2. The system of claim 1, wherein said cassettes are stacked vertically in said MCU.

3. The system of claim 1, wherein said two plate-loading positions are positioned on two opposite sides of said MCU.

4. The system of claim 1, wherein each said cassettes is additionally movable to a plate-filling position.

5. The system of claim 1, wherein each said plate-loading positions is adjacent a respective plate-registration station; and each said plate-registration stations is adjacent one of said imaging units.

6. The system of claim 5, wherein said two plate-registration stations additionally comprise respective punching mechanisms.

7. The system of claim 1, wherein said plurality of plates in each said cassettes is of a single size.

8. The system of claim 1, wherein said CTP device comprises an external drum.

9. A CTP system using two MCUs for feeding one imaging unit, comprising:

an imaging unit;

two MCUs, each comprising a plurality of cassettes, each cassette holding a plurality of plates, each of said cassettes movable in at least one direction to a plate-loading position; and a plate-loading position for receiving cassettes from said two MCUs.

10. The system of claim 9, wherein said cassettes are stacked vertically in each said two MCUs.

11. The system of claim 9, wherein said at least one direction comprises opposite directions for said two MCUs.

12. The system of claim 9, wherein each said cassettes is additionally moveable to a plate-filling position.

13. The system of claim 9, wherein said plate-loading position is adjacent a plate-registration station; and said plate-registration station is adjacent said imaging unit.

14. The system of claim 13, wherein said plate-registration station additionally comprise a punching mechanism.

15. The system of claim 9, wherein said plurality of plates in each said cassettes is of a single size.

16. The system of claim 9, wherein said CTP device comprises an external drum.

17. A method of providing enhanced productivity in a CTP system, comprising the steps of:

providing two CTP systems, each said systems comprising a plate-loading position and an imaging unit;

providing an MCU comprising a plurality of cassettes, each cassette holding a plurality of plates, each said cassettes movable in a first and second directions to the respective two plate-loading positions;

transferring a first cassette to the plate-loading position of a first one of said imaging units;

picking a plate from said transferred first cassette and transferring said picked plate to said first imaging unit; and transferring a second cassette to the plate-loading position of a second one of said imaging units, wherein said transferring a second cassette may be done any time following said step of transferring a first cassette.

18. The method of claim 17, wherein said cassettes are stacked vertically in said MCU.

19. The method of claim 17, wherein said two plate-loading positions are positioned on two opposite sides of said MCU.

20. The method of claim 17, wherein each said cassettes is additionally movable to a plate-filling position.

21. The method of claim 17, wherein said step of transferring said picked plate comprises the steps of:

transferring said picked plate to a registration station for accurately registering said plate with respect to said imaging unit; and transferring said registered plate from said registration station to said imaging unit.

22. The method of claim 21, wherein said registration station additionally comprises a punching mechanism and additionally comprising the step of punching said plate after registration.

23. The system of claim 17, wherein said plurality of plates in each said cassettes is of a single size.

24. The method of claim 17, wherein said CTP device comprises an external drum.

25. A method of providing a large amount of different-sized plates in a CTP device, comprising the steps of:

providing a CTP system, said system comprising a plate-loading position, and an imaging unit;

providing two MCUs, each comprising a plurality of cassettes, each cassette holding a plurality of plates, each said cassettes movable in two directions;

searching said two MCUs for a cassette holding a required plate size;

transferring said cassette from said MCU to said plate-loading position; and picking a plate from said transferred cassette and transferring said picked plate to said imaging unit.

26. The system of claim 25, wherein said cassettes are stacked vertically in said MCU.

27. The system of claim 25, wherein said two MCUs are positioned on two opposite sides of said imaging unit.

28. The system of claim 25, wherein each said cassettes is additionally movable to a plate-filling position.

29. The method of claim 25, wherein said step of transferring said picked plate to said imaging unit comprises the steps of:

transferring said picked plate to a registration station, for accurately registering said plate with respect to said imaging unit; and transferring said registered plate from said registration station to said imaging unit.

30. The method of claim 29, wherein said plate-registration station additionally comprises a punching mechanism and additionally comprising the step of punching said plate after registration.

31. The system of claim 25, wherein said plurality of plates in each said cassettes is of a single size.

32. The method of claim 25, wherein said CTP device comprises an external drum.

* * * * *